US008089435B2

(12) United States Patent
Tu

(10) Patent No.: US 8,089,435 B2
(45) Date of Patent: Jan. 3, 2012

(54) LIQUID CRYSTAL DISPLAY AND DISPLAY PANEL THEREOF

(75) Inventor: Chang-Ching Tu, Taipei County (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 1064 days.

(21) Appl. No.: 11/691,505

(22) Filed: Mar. 27, 2007

(65) Prior Publication Data

US 2008/0117148 A1 May 22, 2008

(30) Foreign Application Priority Data

Nov. 17, 2006 (TW) ..... 95142533 A

(51) Int. Cl.
*G09G 3/36* (2006.01)

(52) U.S. Cl. ..... 345/87; 345/100

(58) Field of Classification Search ..... 345/87–103
See application file for complete search history.

(56) References Cited

U.S. PATENT DOCUMENTS 6,392,626 B1 5/2002 Moon
2004/0239667 A1* 12/2004 Takahashi ..... 345/212
2007/0115241 A1* 5/2007 Teranishi ..... 345/98

FOREIGN PATENT DOCUMENTS

CN 1527271 9/2004

* cited by examiner

*Primary Examiner* — Chanh Nguyen
*Assistant Examiner* — Tsegaye Seyoum
(74) *Attorney, Agent, or Firm* — Jianq Chyun IP Office

(57) ABSTRACT

An LCD and a display panel thereof are provided. A common voltage generation circuit of the display panel is electrically connected to at least one pixel in a non-active pixels region. According to the display voltage at a drain of a TFT in the pixel, an average of display voltages of positive and negative polarities is obtained in two frame times. The average value is regarded as a common voltage supplied to every pixel in an active pixel region in the display panel. Thereby, the problem of a drift of a feed-through voltage ($\Delta V_D$) of a scan voltage due to an RC delay of a parasitic-capacitance and a parasitic-resistance on the scan line can be avoided. Further, the gray-level accuracy of every pixel in the active pixel region can be improved, and the flicker-noise of the display-panel can be reduced, thus significantly promoting the display quality of the LCD.

20 Claims, 7 Drawing Sheets

LIQUID CRYSTAL DISPLAY AND DISPLAY PANEL THEREOF

CROSS-REFERENCE TO RELATED APPLICATION

This application claims the priority benefit of Taiwan application serial no. 95142533, filed Nov. 17, 2006. All disclosure of the Taiwan application is incorporated herein by reference.

BACKGROUND OF THE INVENTION

1. Field of the Invention

The present invention relates to a display and a display panel thereof, and more particularly to a liquid crystal display and a display panel thereof capable of adjusting a common voltage automatically.

2. Description of Related Art

In recent years, liquid crystal displays (LCDS) have been widely adopted and have replaced the conventional cathode ray tube (CRT) displays. Currently, the LCDs have become one of the mainstream products in the market of displays. With the progress of the semiconductor technology, LCD panels have the advantages of low power consumption, slimness and compactness, high resolution, high color saturation, long life time, and so on. Therefore, the LCD panels have been extensively applied in electronic products closely related to daily life, including liquid crystal screens of computers and LCD TVs.

FIG. 1 illustrates a pixel configuration 100 of a conventional thin film transistor liquid crystal display (TFT-LCD). Please refer to FIG. 1. The pixel configuration 100 includes a TFT 101, a liquid crystal capacitance $C_{LC}$, a storage capacitance $C_s$, a common electrode $C_E$, and a parasitic capacitance $C_{gd}$. The electrical connection of the pixel configuration 100 disclosed in FIG. 1 clearly indicates a Cs-on-common design. FIG. 2 illustrates another pixel configuration 200 of the conventional TFT-LCD. Please refer to FIGS. 1 and 2 together. The main difference between the pixel configurations 100 and 200 lies in that the pixel configuration 200 is of a Cs-on-gate design.

When the voltage level of a scan voltage ($V_G$) outputted by a gate driver (not shown) rapidly declines from a high voltage level ($V_{GH}$) to a low voltage level ($V_{GL}$) and the TFT 101 is then switched off, a coupling effect is induced by the parasitic capacitance $C_{gd}$ no matter which pixel configuration is adopted. Thereby, the voltage in a drain d of the TFT 101 is simultaneously dropped by a voltage level ($\Delta V_D$), which can be represented by the following equation 1.

$$\Delta V_D = \frac{C_{gd}}{C_{gd} + C_s + C_{LC}} \Delta V_{GP} \qquad \text{Equation (1)}$$

In equation 1, $\Delta V_{GP}$ is obtained by subtracting the low voltage level ($V_{GL}$) from the high voltage level ($V_{GH}$) i.e. $\Delta V_{GP}=V_{GH}-V_{GL}$. The varying voltage level ($\Delta V_D$) is called a feed-through voltage of the scan voltage, and the value of said feed-through voltage is not a constant.

Due to physical characteristics of liquid crystal molecules, however, the value of the liquid crystal capacitance $C_{LC}$ varies according to different gray-level voltages. Hence, every pixels with different gray levels has different feed-through voltages ($\Delta V_D$) of the scan voltage. In addition, it is well known that each of the scan lines in the display panel (not shown)

includes a parasitic capacitance and a parasitic resistance on a scan line. Accordingly, said $\Delta V_{GP}$ is affected by the parasitic capacitance and the parasitic resistance on the scan line, thus resulting in a so-called RC delay. Thereby, the farther the distance between an input terminal of the scan voltage and its corresponding pixel is, the smaller the value of $\Delta V_{GP}$ becomes. Besides, due to various RC delays on each of the scan lines in the display panel, the feed-through voltages ($\Delta V_D$) of pixels in the same column in the display panel may be different.

As described above, both factors resulting in different feed-through voltages ($\Delta V_D$) of the scan voltages lead to an increase in flicker noises of the display panel, and thereby images displayed by the TFT-LCD flicker. To resolve said problems, relevant solutions disclosed in the related art have been correspondingly developed, including:

1. Adjusting the common voltage Vcom supplied to the pixels in the display panel based on the value of the feed-through voltage ($\Delta V_D$) of the scan voltage.

2. Adopting a technology of driving a three-level or a four-level scan voltage.

Said solution 1 is adapted to the pixel configuration 100 (Cs on common) and to the pixel configuration 200 (Cs on gate), which is implemented by observing and adjusting the common voltage Vcom supplied to the pixels in the display panel through optical measurements, such that the flicker noises in the middle of the display panel can be minimized. Then, after the adjusted common voltage is set, a corrected gamma voltage outside a source driver is fine tuned to eliminate the shift of the feed-through voltage ($\Delta V_D$) Of the scan voltage. Said shift is caused by variation in the value of the liquid crystal capacitance $C_{LC}$ due to different gray-level voltages. It should be mentioned that the problem of the flicker noises at both sides of the display panel is not completely overcome even though said solution 1 minimizes the flicker noises in the middle of the display panel.

FIG. 3 is a diagram of a simulation waveform depicting said solution 1. Please refer to FIGS. 1~3 together. As shown in FIG. 3, the diagram of the simulation waveform includes a waveform of the scan voltage $V_G$, of the data voltage Vs (the data voltage supplied by the source driver and received by the source s of the TFT 101), of the display voltage $V_D$ (the display voltage of the drain d of the TFT 101), and of the common voltage $V_{com}$. Here, the coupling effect induced by said parasitic capacitance $C_{gd}$ generates the feed-through voltage $\Delta V_D$ of the scan voltage, which can be learned from the waveform of the display voltage $V_D$.

In view of the foregoing, complicated manual measurement is required when the solution 1 is adopted to resolve the problem of the feed-through voltage ($\Delta V_D$) of the scan voltage, so as to obtain the best common voltage $V_{com}$ supplied to the pixel in the display panel. Moreover, each display panel has different characteristics, and therefore said best common voltage $V_{com}$ and the fine-tuned corrected gamma voltage outside the source driver may not be applicable to all display panels.

Furthermore, said solution 2 can merely be used in the pixel configuration 200 (Cs on gate) disclosed hereinbefore. FIG. 4 is a diagram of a simulation waveform depicting said solution 2 which adopts a technology of driving a three-level scan voltage. Please refer to FIGS. 2 and 4 together. According to said solution 2, as the scan voltage $V_G$ of the previous scan line $G_{m-1}$ is set at a low voltage level $V_{GL1(m-1)}$, and the feed-through voltage $\Delta V_D$ of the scan voltage $V_G$ of the scan line Gm occurs, the scan voltage of the previous scan line $G_{m-1}$ at the low voltage level $V_{GL1(m-1)}$ is raised by a voltage level $V_p$ to a low voltage level $V_{GL2(m-1)}$. Through said increase in the voltage level and the voltage coupling effects of the storage capacitance $C_s$ and of the parasitic capacitance $C_{gd}$, the shift of the feed-through voltage $\Delta V_D$ of the scan voltage $V_G$ of the scan line $G_m$ is compensated. Theoretically, the voltage level $V_p$ described in said solution 2 can be calculated through the following two equations:

$$\Delta V_D = \frac{C_{gd}}{C_{gd} + C_s + C_{LC}} \Delta V_{GP} \quad \text{Equation (2)}$$

$$\Delta V_D = \frac{C_s}{C_{gd} + C_s + C_{LC}} \Delta V_{GP} \quad \text{Equation (3)}$$

However, if a technology of driving a multi-level e.g. a three- or a four-level scan voltage is intended to be developed according to said solution 2, it is obvious that said development complicates the design of the gate driver. Besides, given that the voltage level $V_p$ cannot be accurately calculated by the gate driver, the feed-through voltage $\Delta V_D$ of the scan voltage $V_G$ of the scan line $G_m$ may be insufficiently or excessively compensated, which results in uncertainties in terms of design and measurement. Moreover, it is required for said solution 2 to be implemented in conjunction with the fine-tuned corrected gamma voltage outside the source driver so as to compensate the shift of the feed-through voltage of the scan voltage. The shift is caused by variation in the value of the liquid crystal capacitance $C_{LC}$ due to different gray-level voltages.

SUMMARY OF THE INVENTION

Accordingly, the present invention provides a display panel, in which a common voltage generation circuit is electrically connected to at least a pixel in a non-active pixel region, and a common voltage of the pixel corresponding to one column of pixels in the display panel is automatically adjusted in N frame time (N is a positive integer, e.g. 2). Thereby, the complicated process of conventional manual adjustment of the common voltage can be eliminated. Furthermore, the common voltage supplied is ensured to be at a best voltage level required by the column of the pixels in the display panel.

The present invention further provides a display to which the spirit of said display panel can be applied. Thereby, not only can the advantages of the display panel disclosed in the present invention be achieved, but the flicker noises of the display panel can be minimized, thus leading to an improvement of the display quality.

The display panel provided by the present invention includes a first pixel region, a second pixel region, and a common voltage generation circuit. The first pixel region includes a plurality of first pixels arranged in array. The second pixel region includes a plurality of second pixels disposed in the periphery of the first pixel region. The common voltage generation circuit is electrically connected to at least one second pixel corresponding to one column of pixels in the first pixel region. Here, the common voltage generation circuit supplies a common voltage to each of the first pixels in the first pixel region based on a display voltage of the second pixel, and the common voltage is an average of the display voltages of positive and negative polarities.

From another aspect, the present invention provides a display including a display panel and a gate driver. The display panel includes a first pixel region, a second pixel region, and a common voltage generation circuit. The first pixel region includes a plurality of first pixels arranged in array. The second pixel region includes a plurality of second pixels disposed in the periphery of the first pixel region. The common voltage generation circuit is electrically connected to at least one second pixel corresponding to one column of pixels in the first pixel region.

The gate driver electrically connected to the display panel includes a plurality of gate lines for sequentially outputting a scan voltage from each of the gate lines to a corresponding scan line of the first pixels and the second pixels based on timing. Here, the common voltage generation circuit supplies a common voltage to each of the first pixels in the first pixel region based on a display voltage of the second pixel, and the common voltage is an average of the display voltages of positive and negative polarities.

According to one embodiment of the present invention, the display further includes a source driver electrically connected to the display panel. The source driver includes a plurality of source lines for outputting the display voltage to a corresponding data line of the first pixels through the source lines based on image data. The display voltage corresponds to the first pixels.

According to one embodiment of the present invention, each of the first and the second pixels includes a transistor and a storage capacitance. A gate terminal of the transistor is electrically connected to a scan line, and a first drain/source terminal thereof is electrically connected to a data line. The storage capacitance includes a first terminal and a second terminal. The first terminal is electrically connected to a second drain/source terminal of the transistor, and the second terminal is adopted to receive the common voltage.

According to one embodiment of the present invention, each of the first and the second pixels includes a parasitic capacitance and a liquid crystal capacitance. The parasitic capacitance has a first and a second terminals. The first terminal is electrically connected to the scan line, and the second terminal is electrically connected to the second drain/source terminal of the transistor. The liquid crystal capacitance includes a first and a second terminals. The first terminal is electrically connected to the second drain/source terminal of the transistor, and the second terminal is adopted to receive the common voltage.

According to one embodiment of the present invention, the transistor includes a TFT.

According to one embodiment of the present invention, the common voltage generation circuit includes a first operational amplifier, a first switch, a second switch, a third switch, a fourth switch, a first capacitance, a second capacitance, a fifth switch, a second operational amplifier, a sixth switch, a third capacitance, and a third operational amplifier. The first operational amplifier includes a positive input terminal, a negative input terminal, and an output terminal. The positive input terminal is electrically connected to the second drain/source terminal of the transistor, while the negative input terminal and the output terminal are electrically connected to each other. The first switch includes a first terminal, a second terminal, and a control terminal. The first terminal is electrically connected to the output terminal of the first operational amplifier.

The second switch includes a first terminal, a second terminal, and a control terminal. The first terminal is electrically connected to the first terminal of the first switch. The third switch includes a first terminal, a second terminal, and a control terminal. The first terminal is electrically connected to the first terminal of the second switch. The fourth switch includes a first terminal, a second terminal, and a control terminal. Here, the first terminal is electrically connected to the second terminal of the first switch, and the second terminal is connected to ground.

The first capacitance includes a first terminal and a second terminal. Here, the first terminal is electrically connected to the second terminal of the first switch, and the second terminal is electrically connected to the second terminal of the second switch. The second capacitance includes a first terminal and a second terminal. Here, the first terminal is electrically connected to the second terminal of the second switch, and the second terminal is electrically connected to the second terminal of the third switch. The fifth switch includes a first terminal, a second terminal, and a control terminal. Here, the first terminal is electrically connected to the second terminal of the third switch, and the second terminal is connected to ground.

The second operational amplifier includes a positive input terminal, a negative input terminal, and an output terminal. The positive input terminal is electrically connected to the second terminal of the second switch, while the negative input terminal and the output terminal are electrically connected to each other. The sixth switch includes a first terminal, a second terminal, and a control terminal. The first terminal is electrically connected to the output terminal of the second operational amplifier. The third capacitance includes a first terminal and a second terminal. Here, the first terminal is electrically connected to the second terminal of the sixth switch, and the second terminal is connected to ground. The third operational amplifier includes a positive input terminal, a negative input terminal, and an output terminal. The positive input terminal is electrically connected to the first terminal of the third capacitance, while the negative input terminal and the output terminal are electrically connected to each other, so as to output the common voltage to each of the first pixels in the first pixel region.

According to one embodiment of the present invention, the control terminals of the first, the second, the third, the fourth, the fifth, and the sixth switches determine an ON/OFF state of the switches based on a corresponding control signal.

According to one embodiment of the present invention, the first, the second, the third, the fourth, the fifth, and the sixth switches are switched off when the control signal is generated in a first phase. The first, the second, and the fifth switches are switched on and the third, the fourth, and the sixth switches are switched off when the control signal is generated in a second phase.

According to one embodiment of the present invention, the first, the second, the third, the fourth, the fifth, and the sixth switches are switched off when the control signal is generated in a third phase. The fourth switch is switched on and the first, the second, the third, the fifth, and the sixth switches are switched off when the control signal is generated in a fourth phase.

According to one embodiment of the present invention, the third and the fourth switches are switched on and the first, the second, the fifth, and the sixth switches are switched off when the control signal is generated in a fifth phase. The fourth and the sixth switches are switched on and the first, the second, the third, and the fifth switches are switched off when the control signal is generated in a sixth phase.

According to one embodiment of the present invention, the column of pixels is positioned in the middle of the first pixel region.

According to one embodiment of the present invention, the display panel includes an LCD panel, while the display includes an LCD.

In the display and the display panel thereof provided by the present invention, the common voltage generation circuit is electrically connected to at least one second pixel in the second pixel region i.e. the non-active pixel region in the display panel, and obtains an average of the voltages having positive and negative polarities in N frame time (N is a positive integer e.g. 2.) according to the display voltage of the drain of the TFT in the second pixel. Then, the average is utilized as the common voltage and provided to each of the first pixels in the first pixel region i.e. the active pixel region in the display panel. Thereby, the complicated process of conventional manual adjustment of the common voltage can be eliminated. Furthermore, the common voltage supplied is ensured to be at the best voltage level required by the column of the pixels in the display panel.

In addition, given that the common voltage generation circuit is electrically connected to more than two second pixels in the second pixel region i.e. the non-active pixel region, the problem of the drift of the feed-through voltage ($\Delta V_D$) caused by an RC delay of the parasitic capacitance and the parasitic resistance on the scan line can be avoided. Thereby, the gray-level accuracy of each of the first pixels in the first pixel region in the display panel can be significantly improved, and the flicker noises of the display panel can be reduced, thus promoting the display quality.

In order to make the aforementioned and other objectives, features and advantages of the present invention comprehensible, several embodiments accompanied with figures are described in detail below.

DESCRIPTION OF EMBODIMENTS

Figure 1:
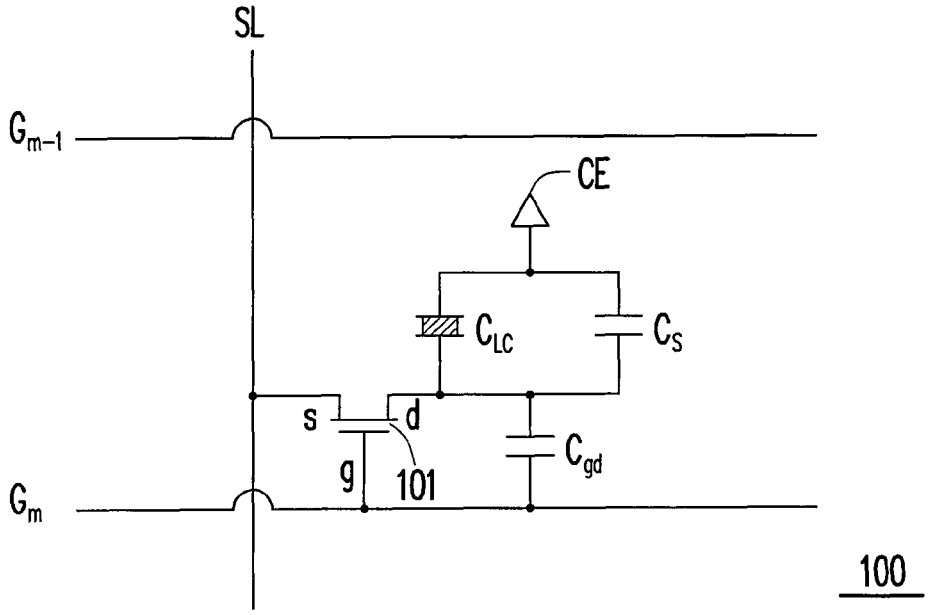
FIG. 1 (PRIOR ART)
FIG. 1 illustrates a pixel configuration of a conventional TFT-LCD.
Figure 2:
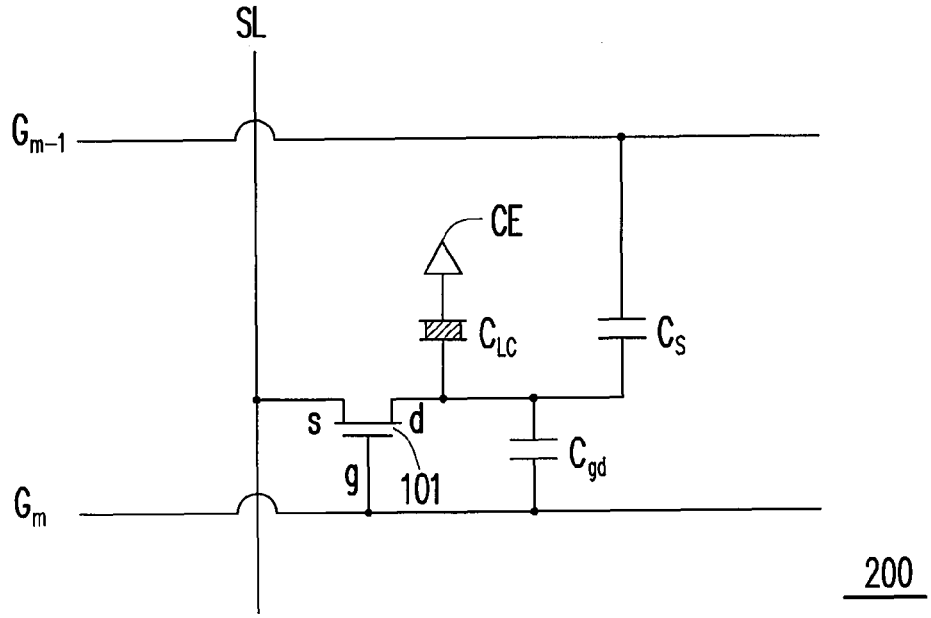
FIG. 2 (PRIOR ART)
FIG. 2 illustrates another pixel configuration of the conventional TFT-LCD.
Figure 3:
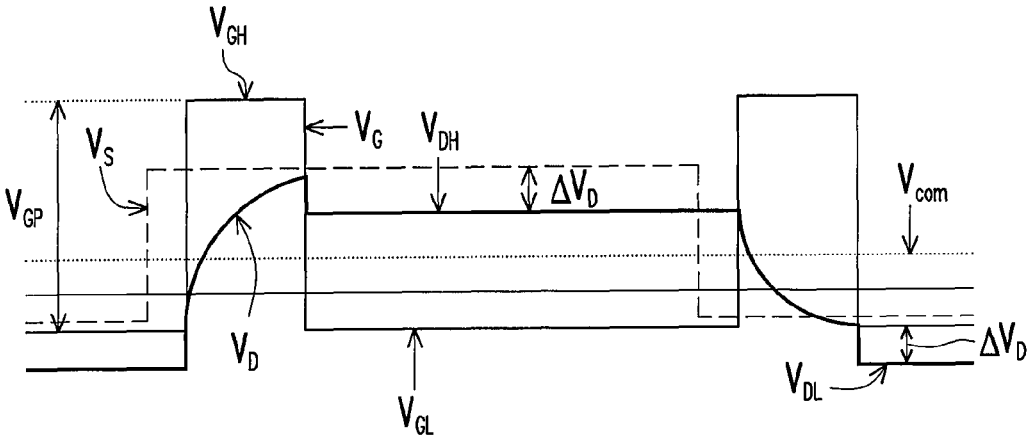
FIG. 3 (PRIOR ART)
FIG. 3 is a diagram of a simulation waveform depicting a conventional solution.
Figure 4:
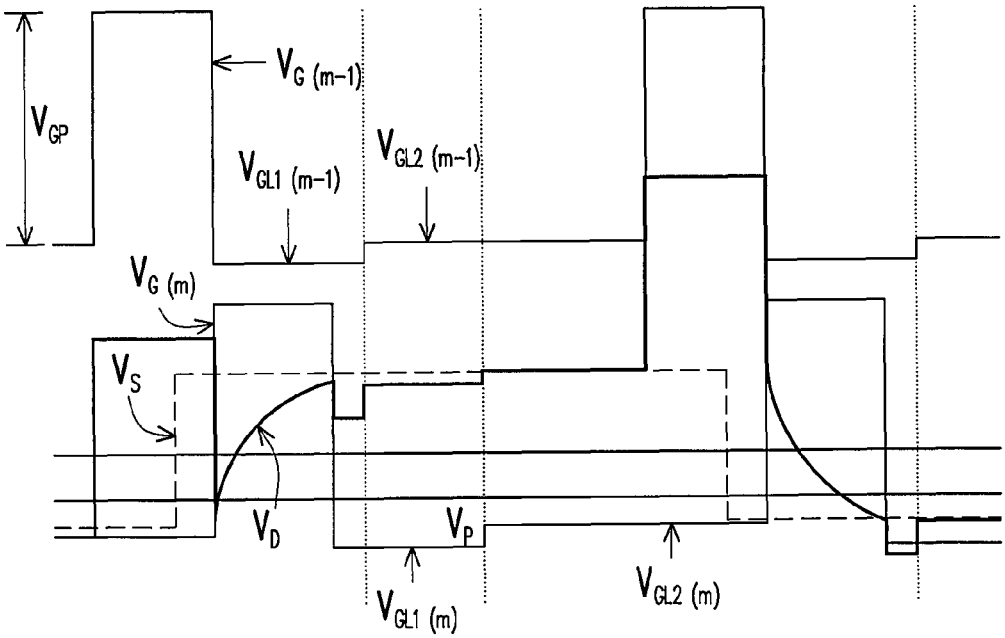
FIG. 4 (PRIOR ART)
FIG. 4 is a diagram of a simulation waveform depicting another conventional solution which adopts a technology of driving a three-level scan voltage.
Figure 5:
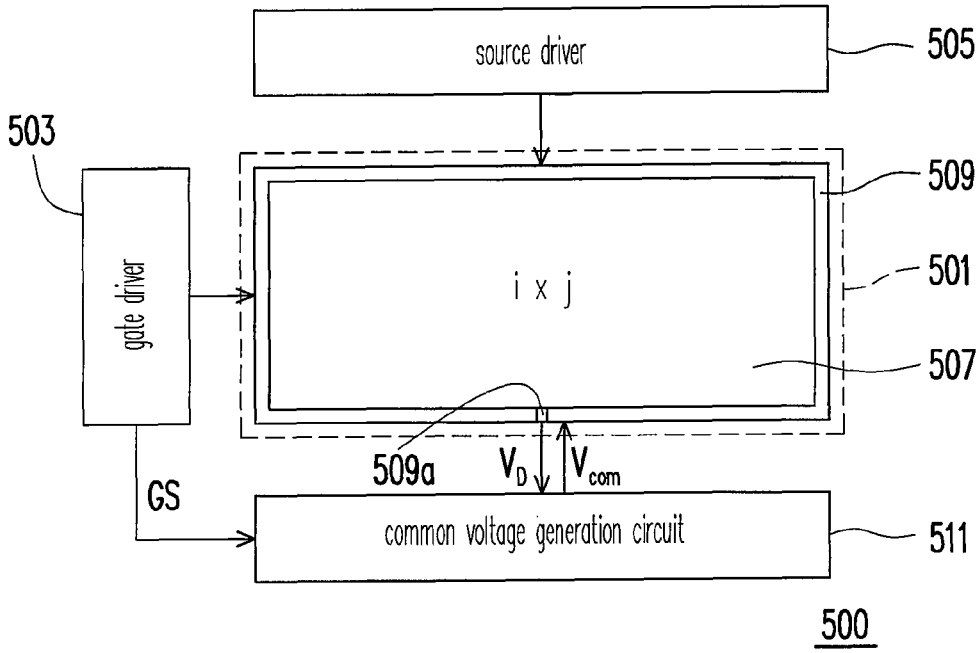
FIG. 5 is a block diagram depicting a display according to one embodiment of the present invention.

FIG. 5 is a block diagram depicting a display 500 according to one embodiment of the present invention. Please refer to FIG. 5. The display 500 e.g. an LCD includes a display panel 501 e.g. an LCD panel, a gate driver 503, and a source driver 505. In the present embodiment, the display panel 501 includes a first pixel region 507, a second pixel region 509, and a common voltage generation circuit 511. The first pixel region 507 has a plurality of first pixels (not shown) arranged in an i*j array for displaying images. Here, i and j are positive integers. The second pixel region 509 has a plurality of second pixels 509*a* disposed in the periphery of the first pixel region 507.

The common voltage generation circuit 511 is electrically connected to one of the second pixels 509*a* in the second pixel region 509, and the second pixel 509*a* corresponds to one column of the pixels in the first pixel region 507. In addition, the common voltage generation circuit 511 provides a common voltage $V_{com}$ to each of the first pixels in the first pixel region 507 based on a display voltage ($V_D$) of the drain of the TFT (not shown) in the second pixel 509*a* electrically connected to the common voltage generation circuit 511. Here, the display voltage at a high voltage level $V_{DH}$ has positive polarity, and the display voltage at a low voltage level $V_{DL}$ has negative polarity. The common voltage $V_{com}$ is an average of the display voltages of positive and negative polarities. Namely, it can be expressed by the following equation.

$$V_{com}=(V_{DH}+V_{DL})/2 \quad \text{Equation (4)}$$

In the second pixel region 509, the amount of the second pixel 509*a* electrically connected to the common voltage generation circuit 511 is not limited in the present embodiment. However, it is required for said second pixel 509*a* to be the one adjacent to the uppermost or the lowermost row in the first pixel region 507. For example, if the display panel resolution of the present embodiment is i*j (e.g. 1024*768, i and j are positive integers), the second pixel 509*a* which is in the second pixel region 509 and is electrically connected to the common voltage generation circuit 511 is disposed in row 0 (in the second pixel region 509 adjacent to the first row of the pixels in the first pixel region 507) or in row 769 (in the second pixel region 509 adjacent to the $768^{th}$ row of the pixels in the first pixel region 507). According to the present embodiment, the second pixel 509*a* corresponding to the column of pixels in the first pixel region 507 is approximately positioned in the middle of the first pixel region 507. Noted that those skilled in the art should know the first pixel region 507 is an active pixel region, while the second pixel region 509 is a dummy pixel region. Thus, it can be known that the gate driver 503 and the source driver 505 of the present embodiment respectively supply a scan voltage and a data voltage not only to each of the first pixels in the first pixel region 507, but also to the row of pixels corresponding to the second pixel 509*a*. However, since the gate driver 503 and the source driver 505 are not the technical features of the present invention, and the principle of driving the gate driver 503 and the source driver 505 is well known to those skilled in the art. Hence, for fear of raising confusion between the related art and the present invention, detailed descriptions are then omitted.

Figure 6:
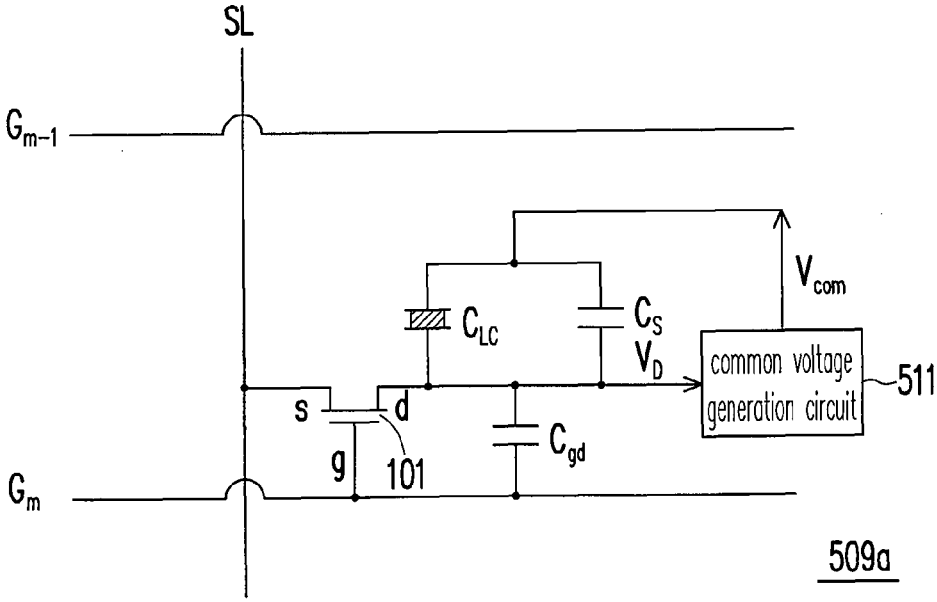
FIG. 6 illustrates a pixel configuration of a second pixel according to one embodiment of the present invention.
Figure 7:
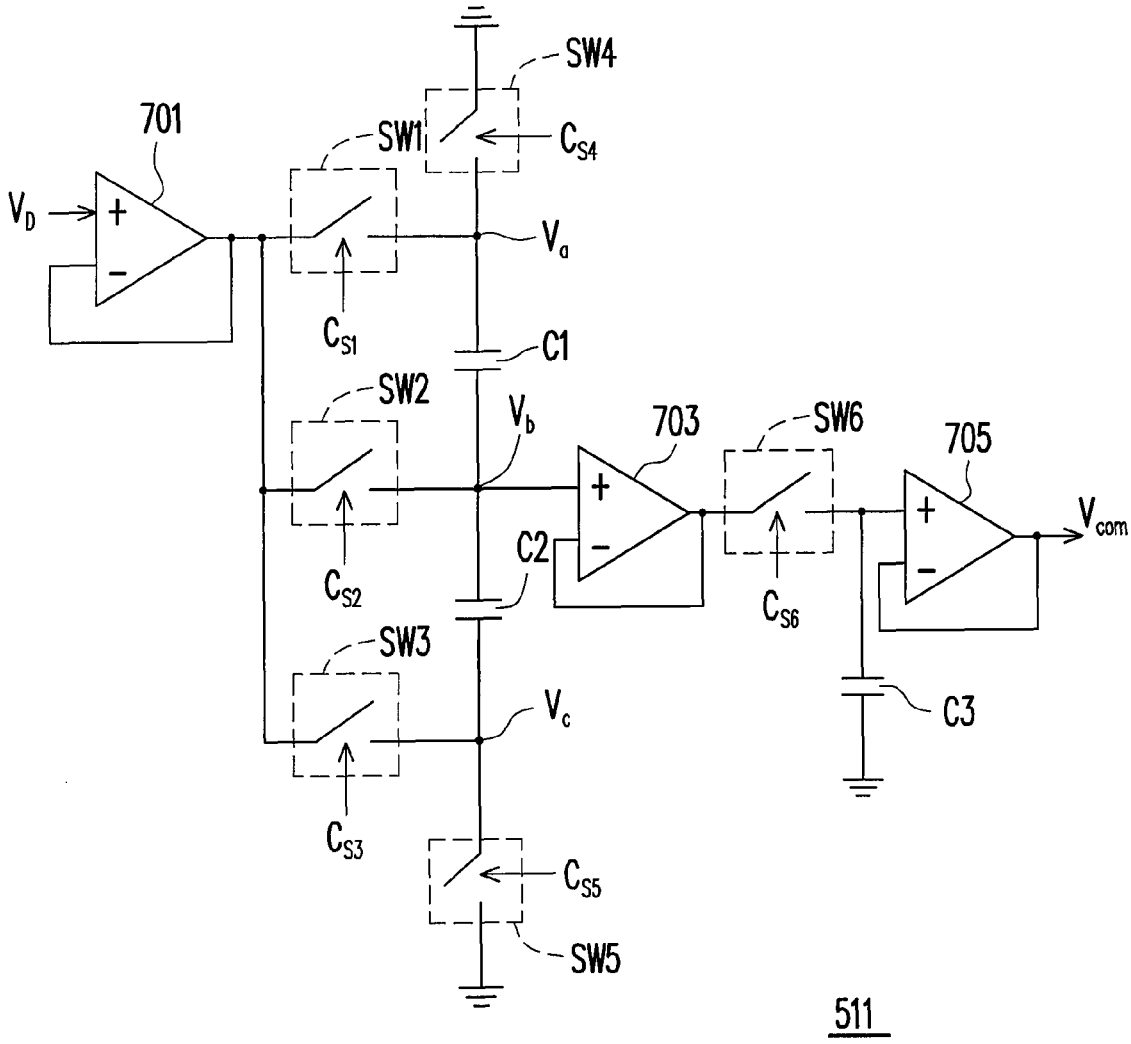
FIG. 7 is a diagram of a common voltage generation circuit according to one embodiment of the present invention.

FIG. 6 illustrates a pixel configuration of a second pixel 509*a* according to the present embodiment. FIG. 7 is a diagram of a common voltage generation circuit 511 according to the present embodiment. Please refer to FIGS. 5~7 together. The second pixel 509*a* depicted in FIG. 6 adopts a Cs-on-common pixel configuration. The common voltage $V_{com}$ supplied to the first pixels and the second pixel 509*a* is provided by the common voltage generation circuit 511 as is disclosed in FIG. 7.

First, please refer to FIG. 7. The common voltage generation circuit 511 of the present embodiment includes operational amplifiers 701, 703, 705, switches SW1~SW6, and capacitances C1~C3. Through the electrical connection between the operational amplifiers 701 and 703 disclosed in FIG. 7, it can be deduced that said operational amplifiers are employed as unit gain buffers to increase a driving force of the received voltage. Thereby, capacitances C1, C2 and a peck detector consisting of the operational amplifier 705 and the capacitance C3 are driven, respectively. Besides, each of the switches SW1~SW6 has a control terminal which determines an ON/OFF state of the switches based on corresponding control signals $C_{S1}$~$C_{S6}$.

Figure 8:
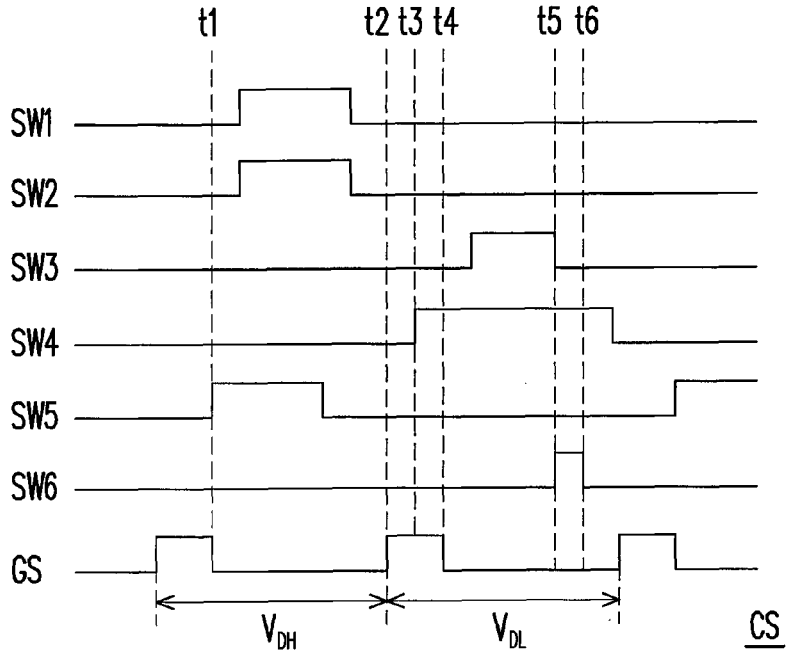
FIG. 8 is a timing diagram of controlling a control signal corresponding to a first to a sixth switches in the common voltage generation circuit according to one embodiment of the present invention.

FIG. 8 is a timing diagram of controlling the control signals $C_{S1}$~$C_{S6}$ corresponding to the control switches SW1~SW6 in the common voltage generation circuit 511 according to the present embodiment. Please refer to FIGS. 5~8 together. It can be learned from the timing diagram in FIG. 8 that the switches SW1~SW6 are switched on correspondingly when pulses of the control signals $C_{S1}$~$C_{S6}$ are high. Hence, the switches SW1~SW6 are switched off at timing t1, which means the common voltage generation circuit 511 is in initial status, and node voltages $V_a=V_b=V_c=0V$. At timing t2 during which the display voltage $V_D$ of the drain of the TFT in the second pixel 509*a* is at the high voltage level (i.e. a high-pulsed display voltage $V_{DH}$), the switches SW1, SW2, SW5 are switched on while SW3, SW4, SW6 are switched off. Here, the switches SW1 and SW2 receive a positive high-pulsed display voltage $V_{DH}$ through the operational amplifier 701, and the node voltages $V_a=V_b=V_{DH}$ while $V_c=0V$.

Then, at timing t3, the switches SW1~SW6 are switched off, and the node voltages $V_a$, $V_b$, and $V_c$ are in floating states. Thereby, the voltage differential between each group of two of the node voltages $V_a$, $V_b$, and $V_c$ remains consistent, and thus it can be deduced that the node voltages $V_a=V_b$, and $V_a-V_c=V_{DH}$. Next, at timing t4, the switch SW4 is switched on while the other switches SW1~SW3, SW5, SW6 are switched off. Accordingly, it can be derived from the law of conservation of electric charges that the node voltages $V_b$ and $V_c$ are in floating states, and the node voltages $V_a=V_b=0V$ while $V_c=-V_{DH}$.

Thereafter, at timing t5 during which the display voltage $V_D$ of the drain of the TFT in the second pixel 509*a* is at the low voltage level (i.e. a low-pulsed display voltage $V_{DL}$), the switches SW3 and SW4 are switched on while SW1, SW2, SW5, SW6 are switched off. Here, the node voltage $V_a=0V$, and $V_b$ is raised from 0V to $[(V_{DH}+V_{DL})/2]V$ in view of the principle of voltage division of the capacitances C1 and C2. Besides, $V_c$ is raised from the negative high-pulsed display voltage $-V_{DH}$ to the positive low-pulsed display voltage $V_{DL}$. Finally, at timing t6, the switches SW4 and SW6 are switched on while the switches SW1~3 and SW5 are switched off. Here, through the operational amplifier 703, the node voltage $V_b$ is supplied to the peak detector consisting of the operational amplifier 705 and the capacitance C3, so as to stabilize the voltage outputted to each of the first pixels in the first pixel region 507. The outputted voltage is regarded as the common voltage $V_{com}$ required by each of the first pixels in the first pixel region 507. Note that the values of the input capacitances of the operational amplifiers 701 and 703 ought to be as small as possible. And the values of the capacitances C1 and C2 must be identical and should be as large as possible. Thereby, the errors in the calculation of said common voltage $V_{com}$ can be eliminated.

From the timing diagram of FIG. 8, the common voltage generation circuit 511 of the present embodiment requires two frame times for calculating the outputted common voltage $V_{com}$. It can also be learned from the timing of a scan signal GS. Here, in the first frame time, the common voltage generation circuit 511 memorizes the high-pulsed display voltage $V_{DH}$, while the common voltage generation circuit 511 memorizes the low-pulsed display voltage $V_{DL}$ in the second frame time. Thereby, according to the order of controlling the switches SW1~SW6 through the control signals CS, the node voltage $V_b$ can be obtained and supplied to each of the first pixels in the first pixel region 507 as the common voltage $V_{com}$ required by each of the first pixels in the first pixel region 507.

From the operation of the common voltage generation circuit 511 disclosed in the present embodiment, it can be learned that the average of two voltage signals inputted at different frame times i.e. the average of the display voltages at the high voltage level $V_{DH}$ and at the low voltage level $V_{DL}$ is obtained. Therefore, the common voltage generation circuit 511 of the present embodiment can be applied to other technical fields in the event of obtaining the average voltage inputted at different frame times.

In the present embodiment, the second pixel 509*a* (the dummy pixel region) is adopted by the common voltage generation circuit 511 to calculate the common voltage $V_{com}$ required by the column of pixels in the display panel 501. Accordingly, the gate driver 503 supplies the scan voltage to enable the row of pixels corresponding to the second pixel 509*a*, and the data voltage supplied by the source driver 505 must be driven in the manner as driving the display panel 501 i.e. a normally white manner or a normally black manner. Thereby, the correct data voltage (white signal or black signal) is correspondingly supplied to the column of pixels, and the gray level of the supplied data voltage must be consistent.

For example, as the display panel 501 is driven in the normally white manner, the data voltage which is supplied to the column of the pixels corresponding to the second pixel 509*a* by the source driver 505 must be a white signal. On the contrary, as the display panel 501 is driven in the normally black manner, the data voltage which is supplied to the column of the pixels corresponding to the second pixel 509*a* by the source driver 505 must be a black signal. Thus, it should be noted that after the common voltage generation circuit 511 of the present invention is operated, the state of the scan voltage outputted by the gate driver 503 and that of the data voltage outputted by the source driver 505 ought to be taken into consideration even though the row of pixels corresponding to the second pixel 509*a* is not used at the time the display panel 501 is driven.

More noticeably, since the second pixel 509*a* is adopted by the common voltage generation circuit 511 to calculate the common voltage $V_{com}$ required by the column of pixels in the display panel 501, the column of pixels corresponding to the second pixel 509*a* is capable of resolving the problem of the feed-through voltage ($\Delta V_D$) of the scan voltage in the display panel, and further eliminating the flicker noises of the display panel 501 thoroughly. As disclosed in the related art, said problem of the feed-through voltage ($\Delta V_D$) of the scan voltage results from the RC delay induced by the parasitic capacitance and the parasitic resistance on the scan line.

Furthermore, in the present embodiment, the RC delay on the scan line poses less impact on the first pixels adjacent to the column of pixels corresponding to the second pixel 509*a* and is disposed in the display panel 501. However, the first pixels far from the middle of the display panel 501 are still likely to be affected by the RC delay on the scan line. Hence, the flicker noises may occur in the first pixels at two sides of the display panel 501.

Despite the flicker noises occurring in the first pixels at two sides of the display panel 501, the flicker noises occurring in the first pixels adjacent to the display panel 501 or corresponding to the second pixel 509*a* can be reduced. Moreover, according to the present embodiment, the common voltage $V_{com}$ supplied to each of the first pixels in the display panel 501 is automatically generated by the common voltage generation circuit 511 rather than supplied outside. Thereby, the voltage across the liquid crystal capacitance $C_{LC}$ and the storage capacitance $C_S$ remains consistent, and the gray level accuracy of each of the first pixels in the first pixel region 507 is further improved. Accordingly, the complicated process of conventional manual adjustment of the common voltage $V_{com}$ can be eliminated, and the best common voltage $V_{com}$ required by the first pixels in the display panel 501 can be obtained.

Said embodiment has taken one second pixel 509*a* in the second pixel region 509 electrically connected to the common voltage generation circuit 511 for an example. To further reduce the flicker noises occurring in the first pixels at two sides of the display panel 501, another embodiment taking a plurality of the second pixels 509*a* in the second pixel region 509 electrically connected to the common voltage generation circuit 511 for an example is provided hereinafter.

Figure 9:
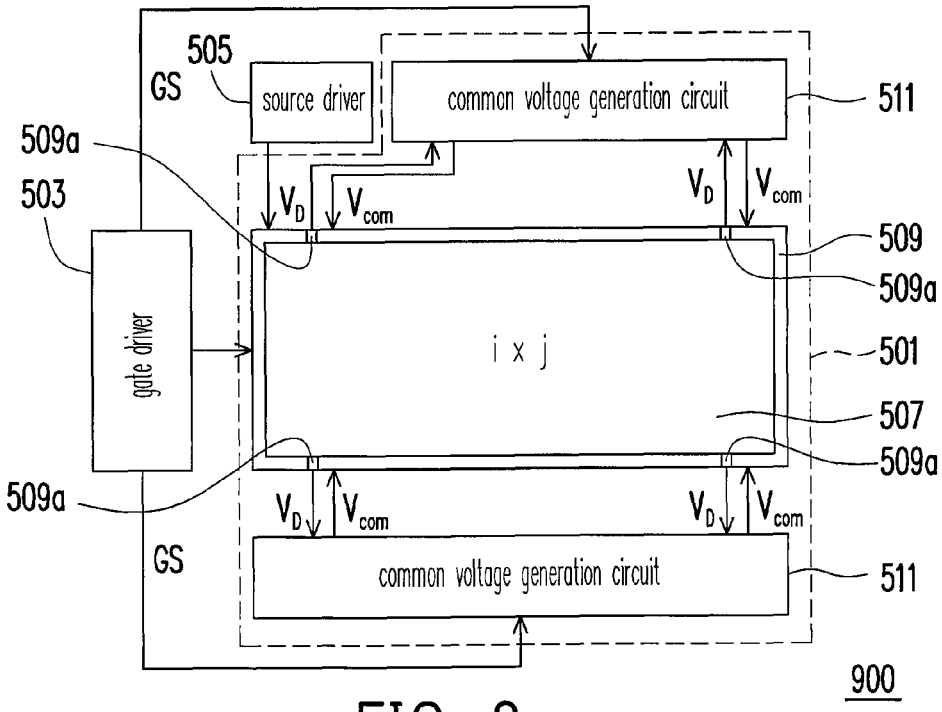
FIGS. 9~13 are block diagrams depicting the display according to another embodiment of the present invention.

FIG. 9 is a block diagram depicting a display 900 according to another embodiment of the present invention. Please refer to FIGS. 5 and 9 together. The difference between the display 900 of FIG. 9 and the display 500 lies in that the common voltage generation circuit 511 is electrically connected to four of the second pixels 509*a* in the second pixel region 509. Here, two of the second pixels 509*a* are disposed adjacent to the uppermost row of the pixels in the first pixel region 507, and the other two of the second pixels 509*a* are disposed adjacent to the lowermost row of the pixels in the first pixel region 507. The disposition represented in FIG. 9 but not limited in the present embodiment can be adjusted according to the design of the display panel 501.

In the present embodiment, since the principle of operating the display panel 501 and the common voltage generation circuit 511 is similar to that of operating the display 500 described in the former embodiment, further descriptions are omitted. Note that the common voltage generation circuit 511 of the present embodiment is electrically connected to four of the second pixels 509*a* in the second pixel region 509. Hence, it can be anticipated that the flicker noises of the display panel 501 are significantly reduced, and the display quality of the display 900 is improved.

Figure 10:
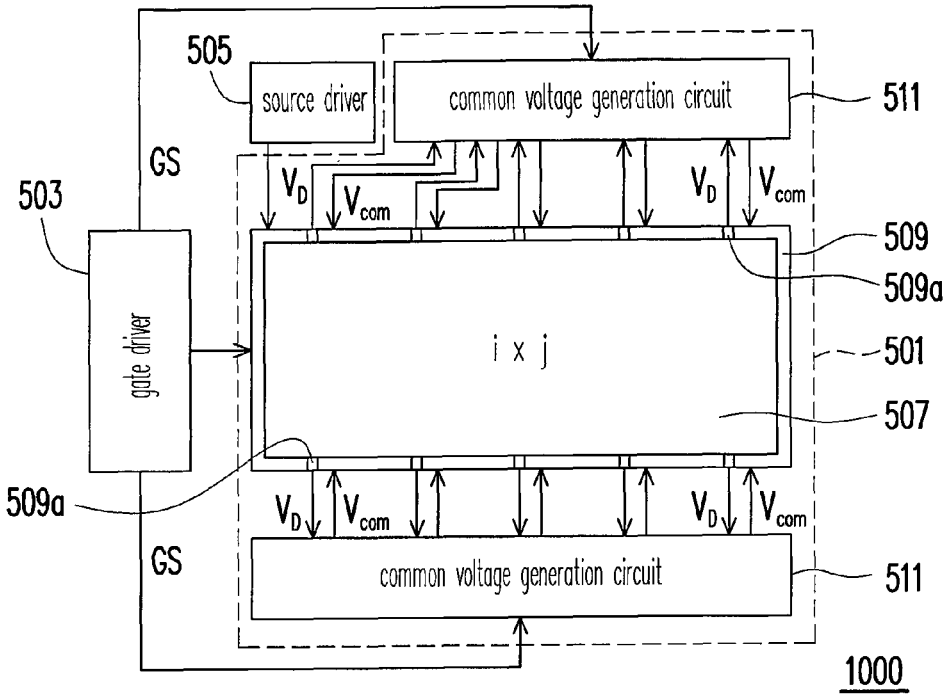

FIG. 10 is a block diagram depicting a display 1000 according to another embodiment of the present invention. Please refer to FIG. 10. In the display 1000 of FIG. 10, the common voltage generation circuit 511 is electrically connected to ten of the second pixels 509*a* in the second pixel region 509. Here, five of the second pixels 509*a* are disposed adjacent to the uppermost row of the pixels in the first pixel region 507, and the other five of the second pixels 509*a* are disposed adjacent to the lowermost row of the pixels in the first pixel region 507. The disposition represented in FIG. 10 but not limited in the present embodiment can be adjusted according to the design of the display panel 501.

In the present embodiment, since the principle of operating the display panel 501 and the common voltage generation circuit 511 is similar to that of operating the display 500 described in the former embodiment, further descriptions are omitted. Note that the common voltage generation circuit 511 of the present embodiment is electrically connected to ten of the second pixels 509*a* in the second pixel region 509. Hence, it can be anticipated that the flicker noises of the display panel 501 are further reduced to a great extent, and the display quality of the display 1000 is better than that of the displays 500 and 900.

According to said embodiment, it can be deduced that when the common voltage generation circuit 511 is electrically connected to more of the second pixels 509*a* in the second pixel region 509, the problem of the drift of the feed-through voltage ($\Delta V_D$) caused by the RC delay of the parasitic-capacitance and the parasitic-resistance on the scan line can be avoided when said embodiment is applied to an actual display panel. Further, the flicker noises of the display panel 501 can be reduced, thus significantly promoting the display quality.

In addition to the above, three embodiments are provided hereinafter based on the spirit of said embodiments of the present invention. According to the following embodiments, a photo mask is adopted to divide a color filter of the display panel into a plurality of areas, and the common voltage generation circuit 511 described above is employed to supply the common voltage required by the pixels in each of the areas. Likewise, the three embodiments also have advantages similar to those of the former embodiments.

Figure 11:
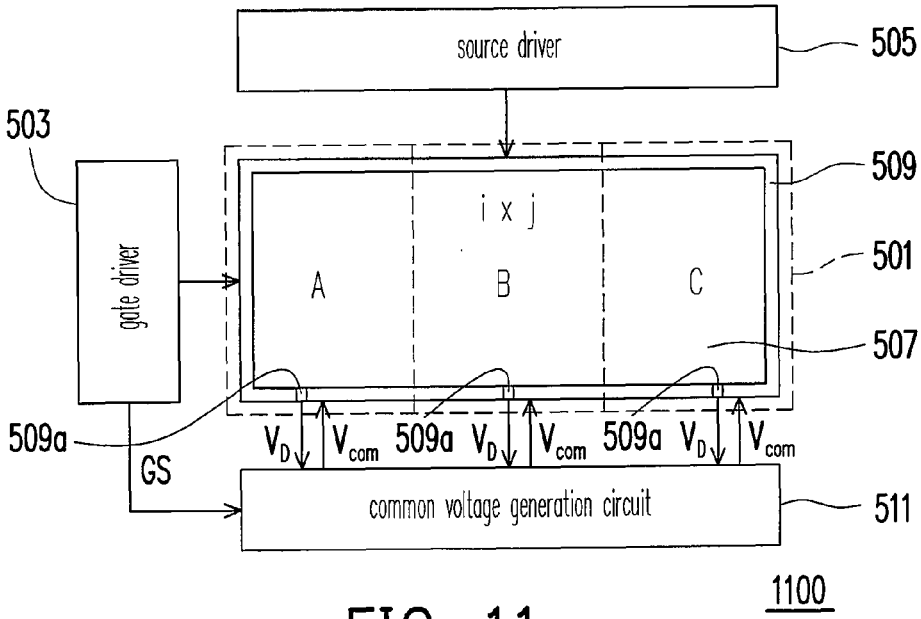

FIG. 11 is a block diagram depicting a display 1100 according to another embodiment of the present invention. Please refer to FIG. 11. The display 1100 adopts a photo mask to divide a color filter (not shown) into three areas. That is, the display panel 501 is divided into three areas: area A, area B, and area C. Here, the areas A, B, and C have corresponding second pixel 509*a* respectively and a common voltage $V_{com}$ provided by the common voltage generation circuit 511. In the present embodiment, since the principle of operating the display 1100 is similar to that of operating the display 500 described in the former embodiments, further descriptions are omitted. Thereby, the problem of the drift of the feed-through voltage ($\Delta V_D$) caused by the RC delay on the scan line of the areas A, B, and C can be avoided when said embodiment is applied to an actual display panel. Further, the flicker noises of the display panel 501 can be reduced, thus significantly promoting the display quality of the display 1100.

Figure 12:
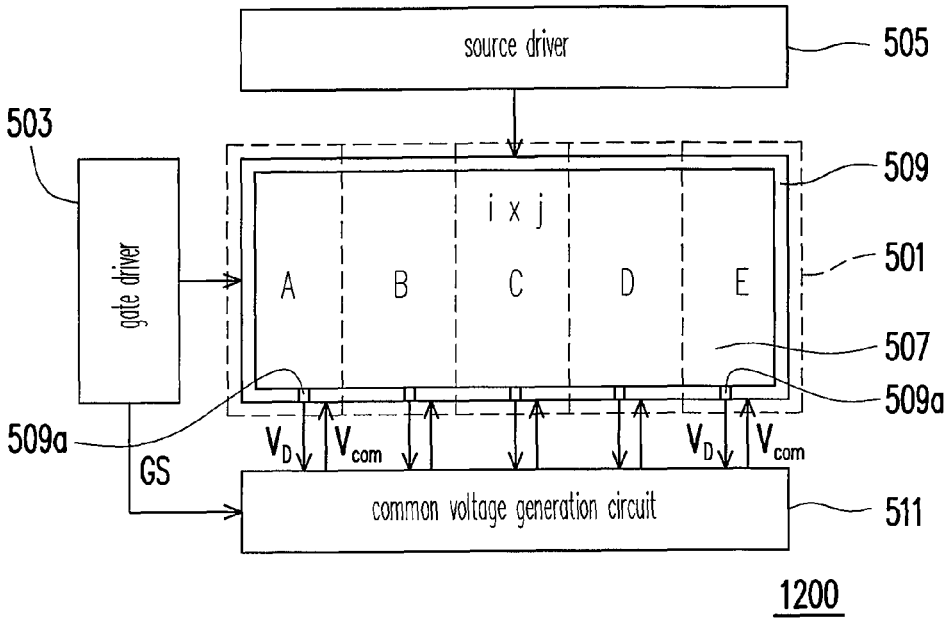
Figure 13:
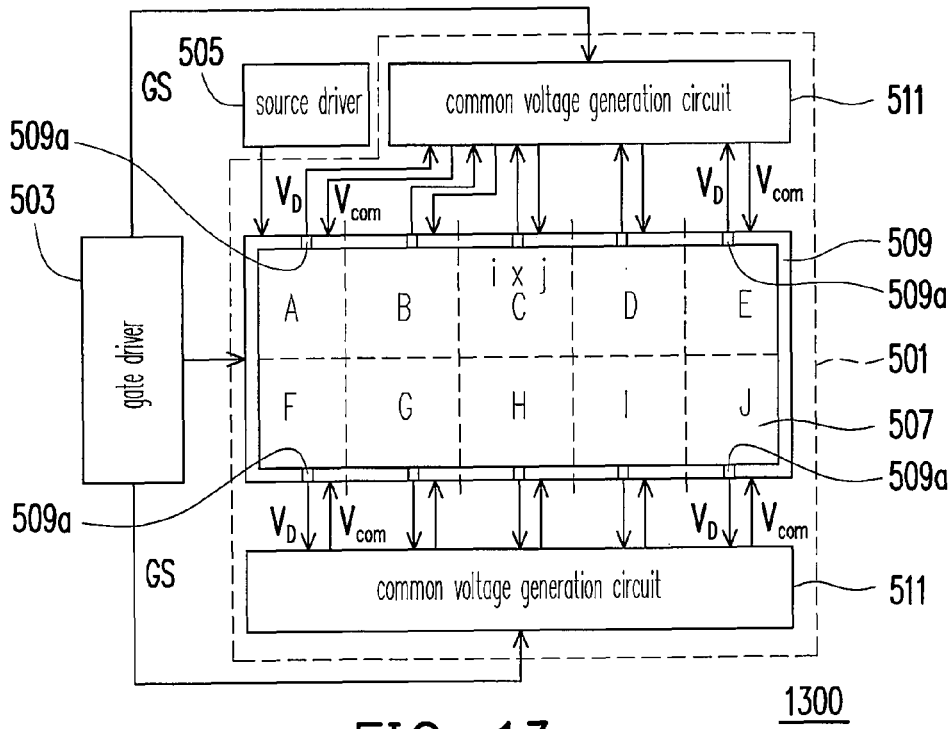

FIGS. 12 and 13 are block diagrams depicting displays 1200 and 1300 according to another embodiment of the present invention. Please refer to FIGS. 11~13 together. The displays 1200 and 1300 are similar to the display 1100. The difference lies in that the display 1200 adopts a photo mask to divide a color filter into five areas, while the display 1300 divides the color filter into ten areas. Thus, the display panel of the display 1200 is divided into five areas A~E, and that of the display 1300 is divided into ten areas A~J. Based on the above, it can be deduced that when the color filter is divided into numerous areas, the display panel thereof is also divided into a great number of areas. And the common voltage generation circuit 511 described above is employed to supply the common voltage required in each of the areas. Thereby, the flicker noises of the display panel can be completely avoided, thus promoting the display quality.

In summary, the present invention provides a display and a display panel thereof. According to the spirit of the present invention, the present invention has the following advantages:

1. Through the electrical connection of the common voltage generation circuit to at least a second pixel in the second pixel region, and through the automatic adjustment of the common voltage of the pixel corresponding to one column of pixels in the display panel in N frame time (N is a positive integer, e.g. 2), the complicated process of conventional manual adjustment of the common voltage can be eliminated. Furthermore, the common voltage provided by the common voltage generation circuit is ensured to be at the best voltage level required by the column of the pixels in the display panel.

2. Through the photo mask, the color filter is divided into a plurality of areas, and so is the display panel. Thereby, the problem of the drift of the feed-through voltage ($\Delta V_D$) of the scan voltage due to the RC delay on the scan line can be avoided. Further, the flicker noises of the display panel can be reduced, thus significantly promoting the display quality.

Although the present invention has been disclosed above by the embodiments, they are not intended to limit the present invention. Anybody skilled in the art can make some modifications and alteration without departing from the spirit and scope of the present invention. Therefore, the protecting range of the present invention falls in the appended claims.

What is claimed is:

1. A display panel, comprising:

a first pixel region, comprising a plurality of first pixels arranged in array;

a second pixel region, comprising a plurality of second pixels disposed around the first pixel region; and a common voltage generation circuit, electrically connected to at least one second pixel corresponding to one column of pixels in the first pixel region, wherein the common voltage generation circuit provides a single common voltage to all of the first pixels based on an average of a display voltage with positive polarity of said at least one second pixel and a display voltage with negative polarity of said at least one second pixel for N adjacent frame-times, and the single common voltage is further adjusted based on an average of a display voltage with positive polarity of said at least one second pixel and a display voltage with negative polarity of said at least one second pixel for next N adjacent frame-times, where N is a positive integer greater than or equal to 2, wherein the common voltage generation circuit comprises:

a first operational amplifier, comprising a positive input terminal, a negative input terminal, and an output terminal, the positive input terminal being electrically connected to the second drain/source terminal of the transistor, the negative input terminal and the output terminal being electrically connected to each other;

a first switch, comprising a first terminal, a second terminal, and a control terminal, the first terminal being electrically connected to the output terminal of the first operational amplifier;

a second switch, comprising a first terminal, a second terminal, and a control terminal, the first terminal being electrically connected to the first terminal of the first switch;

a third switch, comprising a first terminal, a second terminal, and a control terminal, the first terminal being electrically connected to the first terminal of the second switch;

a fourth switch, comprising a first terminal, a second terminal, and a control terminal, the first terminal being electrically connected to the second terminal of the first switch, the second terminal being connected to ground;

a first capacitance, comprising a first terminal and a second terminal, the first terminal being electrically connected to the second terminal of the first switch, the second terminal being electrically connected to the second terminal of the second switch;

a second capacitance, comprising a first terminal and a second terminal, the first terminal being electrically connected to the second terminal of the second switch, the second terminal being electrically connected to the second terminal of the third switch;

a fifth switch, comprising a first terminal, a second terminal, and a control terminal, the first terminal being electrically connected to the second terminal of the third switch, the second terminal being connected to ground;

a second operational amplifier, comprising a positive input terminal, a negative input terminal, and an output terminal, the positive input terminal being electrically connected to the second terminal of the second switch, the negative input terminal and the output terminal being electrically connected to each other;

a sixth switch, comprising a first terminal, a second terminal, and a control terminal, the first terminal being electrically connected to the output terminal of the second operational amplifier;

a third capacitance, comprising a first terminal and a second terminal, the first terminal being electrically connected to the second terminal of the sixth switch, the second terminal being connected to ground; and a third operational amplifier, comprising a positive input terminal, a negative input terminal, and an output terminal, the positive input terminal being electrically connected to the first terminal of the third capacitance, the negative input terminal and the output terminal being electrically connected to each other for outputting the single common voltage, wherein the control terminals of the first, the second, the third, the fourth, the fifth, and the sixth switches determine an ON/OFF state of said switches based on a corresponding control signal.

2. The display panel of claim 1, each of the first and the second pixels comprising:

a transistor, a gate terminal thereof being electrically connected to a scan line, a first drain/source terminal thereof being electrically connected to a data line; and a storage capacitance, comprising a first and a second terminals, the first terminal being electrically connected to a second drain/source terminal of the transistor, the second terminal being adopted to receive the single common voltage.

3. The display panel of claim 2, wherein the transistor comprises a thin film transistor.

4. The display panel of claim 2, each of the first and the second pixels further comprising:

a parasitic capacitance, comprising a first and a second terminals, the first terminal being electrically connected to the scan line, the second terminal being electrically connected to the second drain/source terminal of the transistor; and a liquid crystal capacitance, comprising a first and a second terminals, the first terminal being electrically connected to the second drain/source terminal of the transistor, the second terminal being adopted to receive the single common voltage.

5. The display panel of claim 1, wherein the first, the second, the third, the fourth, the fifth, and the sixth switches are switched off when the control signal is generated in a first phase, and the first, the second, and the fifth switches are switched on and the third, the fourth, and the sixth switches are switched off when the control signal is generated in a second phase.

6. The display panel of claim 1, wherein the first, the second, the third, the fourth, the fifth, and the sixth switches are switched off when the control signal is generated in a third phase, and the fourth switch is switched on and the first, the second, the third, the fifth, and the sixth switches are switched off when the control signal is generated in a fourth phase.

7. The display panel of claim 1, wherein the third and the fourth switches are switched on and the first, the second, the fifth, and the sixth switches are switched off when the control signal is generated in a fifth phase, and the fourth and the sixth switches are switched on and the first, the second, the third, and the fifth switches are switched off when the control signal is generated in a sixth phase.

8. The display panel of claim 1, wherein said one column of pixels corresponding to said at least one second pixel is positioned in the middle of the first pixel region.

9. The display panel of claim 1, wherein the display panel comprises a liquid crystal display panel.

10. A display, comprising:

a display panel, comprising:

a first pixel region, comprising a plurality of first pixels arranged in array;

a second pixel region, comprising a plurality of second pixels disposed around the first pixel region; and a common voltage generation circuit electrically connected to at least one second pixel corresponding to one column of pixels in the first pixel region; and a gate driver electrically connected to the display panel, the gate driver comprising a plurality of gate lines for sequentially outputting a scan voltage from each of the gate lines to a corresponding scan line of the first and the second pixels based on timing, wherein the common voltage generation circuit provides a single common voltage to all of the first pixels based on an average of a display voltage with positive polarity of said at least one second pixel and a display voltage with negative polarity of said at least one second pixel for N adjacent frame-times, and the single common voltage is further adjusted based on an average of a display voltage with positive polarity of said at least one second pixel and a display voltage with negative polarity of said at least one second pixel for next N adjacent frame-times, where N is a positive integer greater than or equal to 2, wherein the common voltage generation circuit comprises:

a first operational amplifier, comprising a positive input terminal, a negative input terminal, and an output terminal, the positive input terminal being electrically connected to the second drain/source terminal of the transistor, the negative input terminal and the output terminal being electrically connected to each other;

a first switch, comprising a first terminal, a second terminal, and a control terminal, the first terminal being electrically connected to the output terminal of the first operational amplifier;

a second switch, comprising a first terminal, a second terminal, and a control terminal, the first terminal being electrically connected to the first terminal of the first switch;

a third switch, comprising a first terminal, a second terminal, and a control terminal, the first terminal being electrically connected to the first terminal of the second switch;

a fourth switch, comprising a first terminal, a second terminal, and a control terminal, the first terminal being electrically connected to the second terminal of the first switch, the second terminal being connected to ground;

a first capacitance, comprising a first terminal and a second terminal, the first terminal being electrically connected to the second terminal of the first switch, the second terminal being electrically connected to the second terminal of the second switch;

a second capacitance, comprising a first terminal and a second terminal, the first terminal being electrically connected to the second terminal of the second switch, the second terminal being electrically connected to the second terminal of the third switch;

a fifth switch, comprising a first terminal, a second terminal, and a control terminal, the first terminal being electrically connected to the second terminal of the third switch, the second terminal being connected to ground;

a second operational amplifier, comprising a positive input terminal, a negative input terminal, and an output terminal, the positive input terminal being electrically connected to the second terminal of the second switch, the negative input terminal and the output terminal being electrically connected to each other;

a sixth switch, comprising a first terminal, a second terminal, and a control terminal, the first terminal being electrically connected to the output terminal of the second operational amplifier;

a third capacitance, comprising a first terminal and a second terminal, the first terminal being electrically connected to the second terminal of the sixth switch, the second terminal being connected to ground; and a third operational amplifier, comprising a positive input terminal, a negative input terminal, and an output terminal, the positive input terminal being electrically connected to the first terminal of the third capacitance, the negative input terminal and the output terminal being electrically connected to each other for outputting the single common voltage, wherein the control terminals of the first, the second, the third, the fourth, the fifth, and the sixth switches determine an ON/OFF state of said switches based on a corresponding control signal.

11. The display of claim 10, further comprising a source driver electrically connected to the display panel, the source driver comprising a plurality of source lines for outputting the display voltage to a corresponding data line of the first pixels through the source lines based on image data.

12. The display of claim 11, each of the first and the second pixels comprising:

a transistor, a gate terminal thereof being electrically connected to the scan line, a first drain/source terminal thereof being electrically connected to the data line correspondingly; and a storage capacitance, comprising a first and a second terminal, the first terminal being electrically connected to a second drain/source terminal of the transistor, the second terminal being adopted to receive the single common voltage.

13. The display of claim 12, wherein the transistor comprises a TFT.

14. The display of claim 12, each of the first and the second pixels further comprising:

a parasitic capacitance, comprising a first and a second terminals, the first terminal being electrically connected to the scan line, the second terminal being electrically connected to the second drain/source terminal of the transistor; and a liquid crystal capacitance, comprising a first and a second terminals, the first terminal being electrically connected to the second drain/source terminal of the transistor, the second terminal being adopted to receive the single common voltage.

15. The display of claim 10, wherein the first, the second, the third, the fourth, the fifth, and the sixth switches are switched off when the control signal is generated in a first phase, and the first, the second, and the fifth switches are switched on and the third, the fourth, and the sixth switches are switched off when the control signal is generated in a second phase.

16. The display of claim 10, wherein the first, the second, the third, the fourth, the fifth, and the sixth switches are switched off when the control signal is generated in a third phase, and the fourth switch is switched on and the first, the second, the third, the fifth, and the sixth switches are switched off when the control signal is generated in a fourth phase.

17. The display of claim 10, wherein the third and the fourth switches are switched on and the first, the second, the fifth, and the sixth switches are switched off when the control signal is generated in a fifth phase, and the fourth and the sixth switches are switched on and the first, the second, the third, and the fifth switches are switched off when the control signal is generated in a sixth phase.

18. The display of claim 10, wherein said one column of pixels corresponding to said at least one second pixel is positioned in the middle of the first pixel region.

19. The display of claim 10, wherein the display panel comprises an LCD panel.

20. The display of claim 10, wherein the display comprises an LCD.

* * * * *